US006381825B1

(12) United States Patent
Regis et al.

(10) Patent No.: US 6,381,825 B1
(45) Date of Patent: May 7, 2002

(54) METHOD FOR PACKING FIBERS INTO A CASE

(75) Inventors: Muriel Regis, Bourges; Martial Bernard, Soye en Septaine; André Espagnacq, Bourges, all of (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/627,005

(22) Filed: Jul. 27, 2000

(30) Foreign Application Priority Data

Jul. 27, 1999 (FR) ..... 99.09773

(51) Int. Cl.[7] ..... B23P 17/00

(52) U.S. Cl. ..... 29/419.1; 29/458; 264/257; 102/505; 342/12

(58) Field of Search ..... 29/870, 872, 417, 29/419.1, 447, 452, 458, 728; 264/159, 257; 102/504, 505; 342/12; 242/472.5, 470, 362, 127, 604

(56) References Cited

U.S. PATENT DOCUMENTS 3,232,553 A * 2/1966 Kitselman ..... 242/362
3,300,158 A * 1/1967 Strong ..... 242/362
3,453,959 A * 7/1969 Hobart et al. ..... 102/505
3,466,210 A * 9/1969 Wareham ..... 29/596
4,261,099 A 4/1981 Gainer, Jr.
5,179,778 A 1/1993 Dickson et al.
5,328,494 A * 7/1994 Kelman et al. ..... 264/257
5,659,147 A 8/1997 Rouse et al.

FOREIGN PATENT DOCUMENTS

GB 1598423 9/1981
GB 2089761 A * 6/1982
JP 06190272 A * 7/1994

* cited by examiner

*Primary Examiner*—S. Thomas Hughes
*Assistant Examiner*—Jermie E. Cozart
(74) *Attorney, Agent, or Firm*—Parkhurst & Wendel, L.L.P.

(57) ABSTRACT

A method for stacking fibers less than 10 mm long into a cartridge case, including an impregnation stage for fibers arrayed into at least one skein together with a solidifiable material, the skein being solidifiable inside a mold and then, in the solidified state, being cut into at least two slices each of a thickness which is the desired fiber length. Such cartridges are for use as screens or decoys against radar or other detection or guidance systems.

19 Claims, 5 Drawing Sheets

METHOD FOR PACKING FIBERS INTO A CASE

FIELD OF THE INVENTION

The invention relates to methods for packing fibers less than 10 mm long in a case. More particularly, the present invention pertains to cartridges filled with such fibers for grenades or projectiles dispersing such fibers, for instance to act as screens or decoys in the infrared and/or millimeter wavelength range.

FIELD OF THE INVENTION

It is already known from U.S. Pat. No. 5,659,147 to make grenades or projectiles which when deployed release fiber particles along their paths to disperse carbon or aluminized glass fiber. Such projectiles are used for close-range defense of aircraft or armored vehicles against missiles equipped with homing radar operating in the mm range (17 to 94 GHz, and in particular 35 to 94 GHz).

The main problem in producing such cartridges is how to optimally fill them with a maximum quantity of short length fibers. The length of the dispersed fibers should be less than 10 mm to assure screening efficacy in the desired wavelength range.

The lengths of the dispersed fibers should be roughly the same as the wavelength of the radiation against which screening is desired, namely the fibers should be 3 to 6 mm when seeking infrared screening in the mm range (radiation absorbing carbon fibers also will assure infrared screening).

Generally, the shell cartridges are filled in bulk. Accordingly, the shell will not be filled optimally, and cartridge performance is not reliably reproducible due to variations among cartridge weight and fiber distribution.

Moreover, cartridges are known wherein the short fibers (of aluminized glass) are stacked like layers of small diameter (less than 40 mm for fiber lengths larger than or equal to 5 mm). Such a design improves the packing density.

U.S. Pat. No. 5,179,778 describes such a method for packing fibers into a cartridge case. This procedure employs a bush which is drawn with great force to assure radially compacting the fibers into a skein. This skein thereupon is cut into disks.

This is a complex procedure. The fibers may not rest affixed to the disks so cut off. In particular when the disk diameter is larger than 40 mm, their thickness is between 3 and 7 mm, and the disks comprise clearance receiving several pyrotechnic dispersion charges.

The objective of the present invention is a method for palliating the above cited drawbacks.

The present invention method allows packing short fibers (less than 10 mm long) in a simple and economical manner in a case, in the form of sliced disks, herein called slices, whose diameters may be large (more than 40 mm) and comprise clearances.

Thus, the objective of the invention is a method for packing fibers less than 10 mm long into a case, particularly a cartridge, the method being characterized by the following stages:

at least one set of long fibers is rearranged into at least one skein, the skein(s) is (are) impregnated with a material having a first solidification point, the skein(s) so impregnated are placed into a mold, the skein(s) is (are) solidified inside the mold whose temperature is changed to the first solidification point, when solidified, the skein(s) is (are) cut into at least two slices, each slice thickness being the desired fiber length, the impregnation material is eliminated by raising the slices to a second temperature before or after the slices are stacked in the case.

The solidified skein can be cut when inside the mold which is fitted with recesses allowing passage of a cutting means.

Alternatively, the solidified skein can be withdrawn from the mold and fitted with a support sheath before cutting the skein into slices.

The mold may feature a semi-cylindrical cavity to impart a semi-cylindrical shape to the solidified skein, first at least two identical skeins being manufactured which then are assembled within a single cylindrical support sheath.

The mold may include a cover having a semi-cylindrical contour which makes it possible to subtend a cylindrical, axial half duct in the solidified skein.

An axial duct may be implemented by drilling through the skein or the solidified slices.

After the axial duct has been implemented in the solidified skein, but before cutting, a tube filled with the same impregnating material and in the solidified state can be advantageously housed inside this axial duct.

The support sheath may be heat-shrinking, or it may a metallic sheath.

In the latter case, the metal sheath may be a screen of which the mesh width is less than 140$\mu$.

The metal case may comprise a foil enveloping the skein and soldered edge to edge.

The array of the long fibers into a skein can be implemented by winding a long fiber between two pins mounted on a support.

Alternatively, the rearrangement of the long fibers into a skein may be implemented by winding a unidirectional web on itself.

The solidifying material may be water, or it may contain water.

The solidifying material may have a solidification point higher than 0° C. and a melting or boiling point less than 150° C. It may be a wax.

The fibers may be carbon fibers or glass fibers covered with a conducting material such as aluminum, or conducting organic fibers.

BRIEF DESCRIPTION OF THE DRAWINGS

The invention is elucidated in the following description of particular modes of implementation of the invention and in relation to the attached drawings.

DETAILED DESCRIPTION OF PREFERRED EMBODIMENTS

Figure 1:
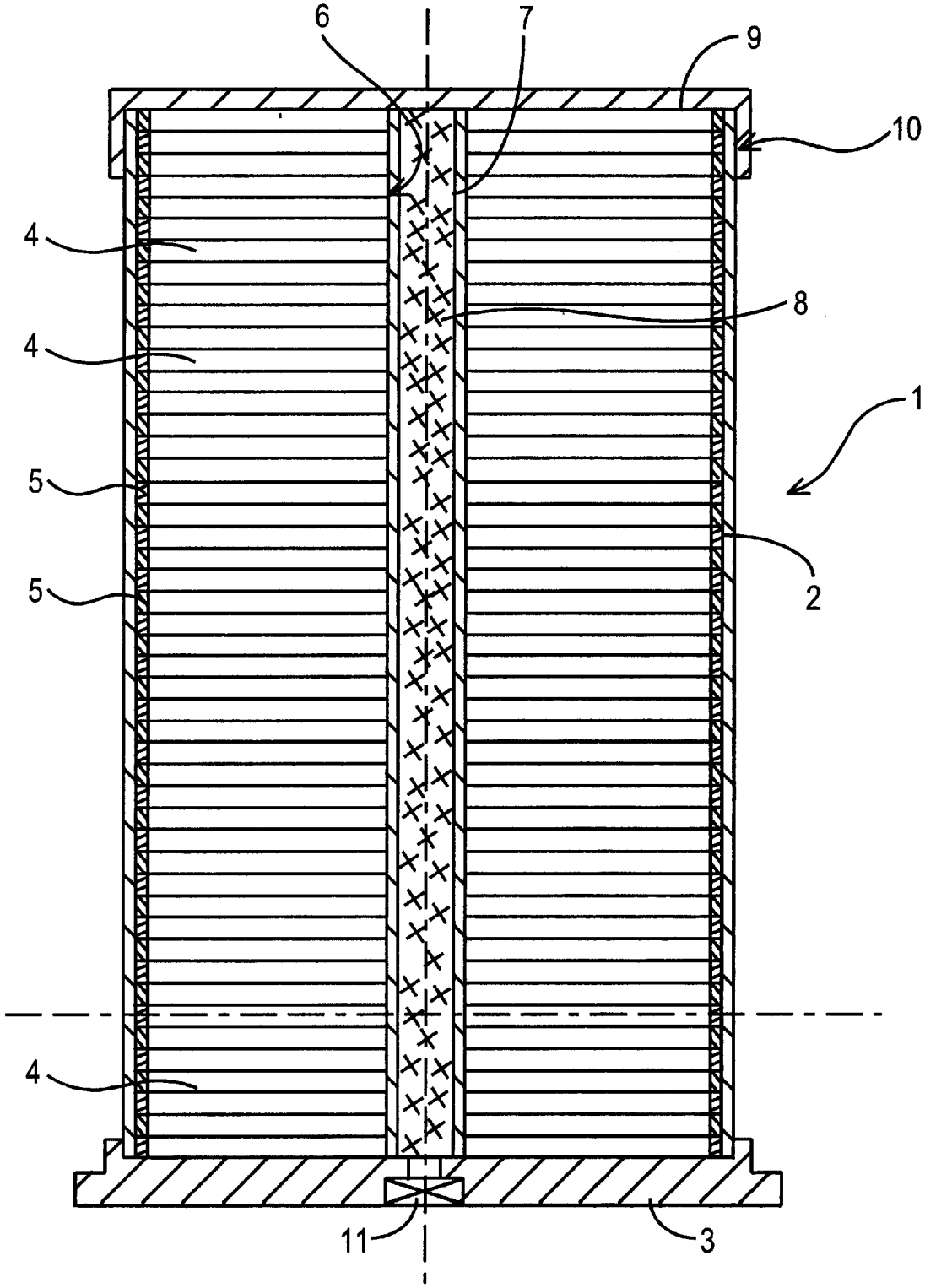
FIG. 1 is a longitudinal section of a cartridge made by the method of the invention.

FIG. 1 shows a cartridge 1 made by the method of the invention and comprising a case 2, which may or may not be pre-fragmented, and which illustratively is made of a plastic such as plexiglass, a polycarbonate or polyethylene, and, here, is firmly affixed to an illustratively metallic base 3. The base is designed to affix the cartridge to a known launcher, not shown.

Illustratively, such a launcher may be carried by either aircraft or ground vehicles. The launcher is understood to comprise a conventional cartridge guide tube and an expulsion piston driven by a gas-generating charge.

The case 2 encloses a stack of carbon-fiber sliced disks, hereafter referred to as slices 4.

The thickness of each slice 4 is less than 10 mm and the fibers are all arrayed mutually parallel within each slice. The fiber diameter is roughly 7 $\mu$ and their length is that of the slice thickness. Preferably the slice thickness is between 3 and 6 mm.

Each slice is enclosed by an external sheath 5 which keeps the fibers in place. This sheath is made of plastic or metal. For example, a heat-shrinking plastic may be used. The heat-shrink sheath is selected in such manner that following shrinkage, its diameter is that of the slice and its shrinkage temperature is less than the fibers' decomposition temperature, typically less than 150° C.

A foil or a mesh of stainless steel 20 to 140 $\mu$ thick also may be used. How to configure the sheath and implement the slices are described below.

In one variation, the sheath 5 may be omitted, provided another embodiment, also described further below, is used.

Each slice includes an axial hole and the stacking of the slices 4 therefore forms an axial duct 6 inside which is situated a tube 7, made of cardboard, plastic, or other suitable material. The tube is filled with a pyrotechnical dispersion charge 8.

Alternatively, each slice's washer may comprise a tube portion, with juxtaposition of the various washers forming the tube 7.

Illustratively, the dispersion charge 8 comprises a pyrotechnical composition combining aluminum and potassium perchlorate ($Al/KClO_4$) in respective proportions by weight of 20 to 30% aluminum and 80 to 70% $KClO_4$, preferably 24% Al and 76% $KClO_4$.

A fragmenting cover 9 illustratively made of plastic seals the case 2. The cover is firmly affixed to the case 2 by bonding its peripheral flange 10 onto the external cylindrical surface of the case. However, the cover also may be made integral with the case.

The base 3 is fitted with a conventional ignition device 11 which here is not described in further detail. The ignition device may include an electronic or pyrotechnical delay means that is triggered upon firing the cartridge, which further comprises a flammable composition, thereby assuring ignition of the pyrotechnical dispersion charge 8.

The gas pressure following ignition of the charge bursts the case 2 and disperses the slice-constituting fibers.

In this manner, the dispersion creates a cloud of fibers offering screening in the mm and/or infrared range, or another function such as electrical shorting. A decoy cartridge may be constructed by replacing the fibers with reflecting chaff, for example, aluminum filaments.

The outside diameter of the slices is roughly 70 mm, the diameter of the axial duct 6 is roughly 15 mm—ultimately, the duct diameter varies in relation to the kind of case and the quantity of charge 8 used to rupture the particular case and to disperse the fibers.

In this manner, approximately 88 million fibers, each 6 mm high may be concentrated in a single slice 4. Therefore, one. cartridge, with a 100 mm stack of slices, may carry approximately 1.5 billion fibers.

The fibers are distributed very homogeneously and symmetrically, their surface density being about 24,000 fibers/mm$^2$.

Such a cartridge allows generation of a large cloud in a reliable and reproducible manner. Illustratively, a cartridge 40 mm in diameter and 60 mm long generates a cloud 2 meters in diameter.

In an embodiment variation, the carbon fibers may be replaced with aluminum-coated glass fibers, aluminized ribbons, or conducting organic fibers or fibers based on conductive polymers.

Such a cartridge is implemented by the following method of making the invention.

The method of making the present invention is described below mainly in reference to FIG. 6, which schematically shows its various stages of manufacture.

First, a fiber skein 12 of mutually parallel fibers made of carbon, aluminized glass, or an aluminized organic material, is manufactured in stage A. The skein cross-section contains a number of fibers corresponding to the desired number of fibers in a cartridge cross-section.

Figure 2:
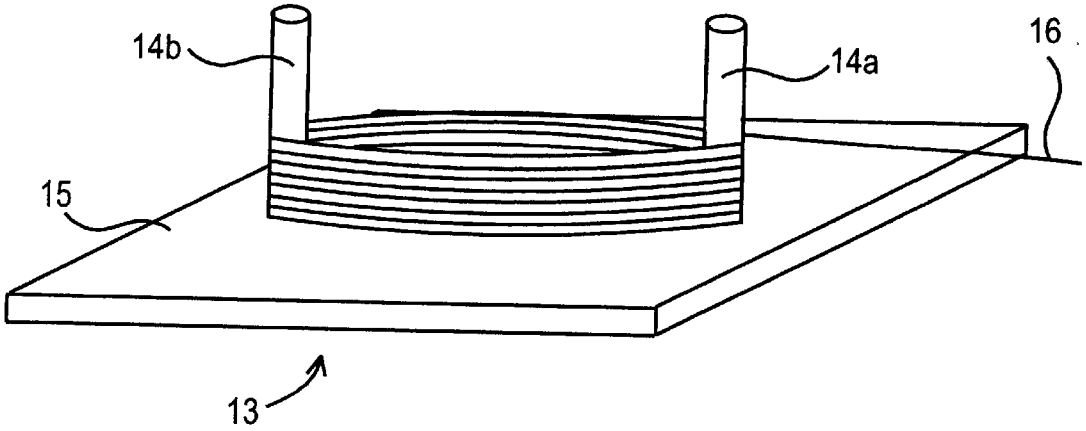
FIG. 2 is a perspective of a jig for making a skein of a particular embodiment of the invention.

This skein 12 may be manufactured by continuously winding a single fiber between two pins. FIG. 2 shows such a jig 13 implementing such winding.

The jig 13 comprises a support base 15 onto which are affixed two cylindrical pins 14*a*, 14*b*. A fiber 16 is wound between the two pins by a winding device, not shown. Alternatively, the base support 15 may be affixed to a lathe-like device to implement fiber winding.

The distance between the two pins 14*a*, 14*b* defines the length of the skein 12. The length of the skein is compatible with the winding device's capacity. If the length is not excessive, it may equal at least the stack height of the desired fiber slices.

If the cartridge length is excessive, several skeins may be manufactured which are subsequently cut to size in the manner described below to implement the slices. Thereupon, the appropriate number of slices are combined to attain a cartridge of a given length.

In this manner, a skein 12 of given length can be manufactured in an accurate manner with the desired numbered of fibers.

Illustratively, considering a cartridge to house 12 slices 40 mm in diameter and 5 mm thick and containing 24,000 fibers/mm$^2$ each 7 $\mu$ in diameter, 322 m of fiber can be wound between two pins spaced apart by 140 mm. The number of possible slices using such a skein is larger than 15, only 12 slices typically being kept for the cartridge.

The skein 12 also may be implemented by winding a unidirectional fabric of fibers. Such a fabric is well known in the art, its fibers all being mutually parallel and interconnected within the fabric by nylon threads perpendicular to them to assure low mechanical strength perpendicular to the fiber.

Figure 5:
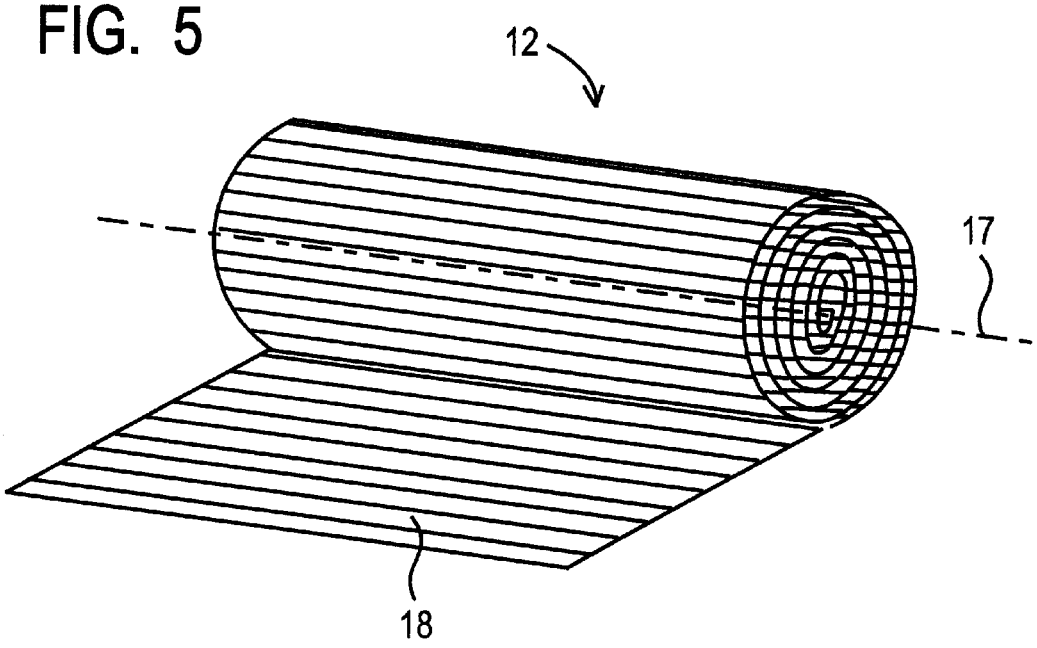
FIG. 5 is a perspective of a particular embodiment of a skein.
Figure 6A:
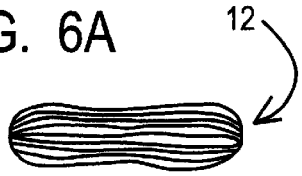
FIG. 6 schematically shows the sequence of the main stages of the method of the invention.
Figure 6B:
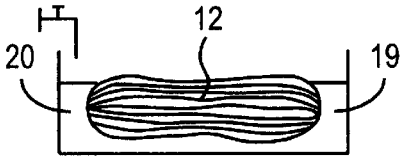
Figure 6C:
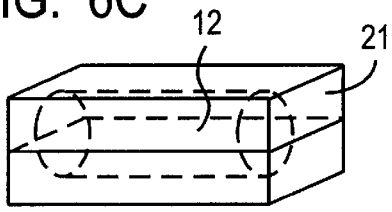
Figure 6D:
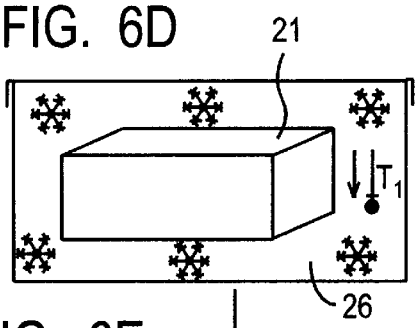
Figure 6G:
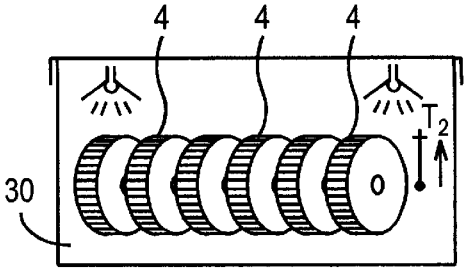
Figure 6H:
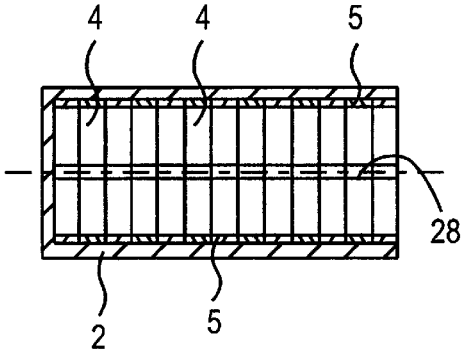
Figure 6H:
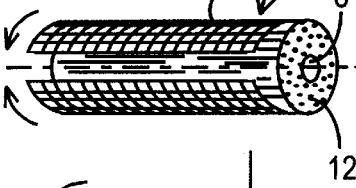
Figure 6H:
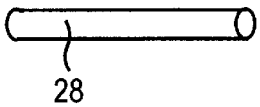
Figure 6H:
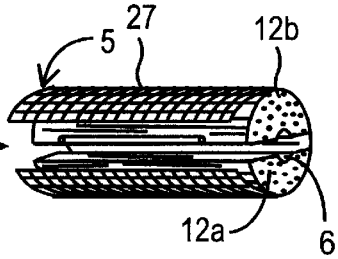
Figure 6F:
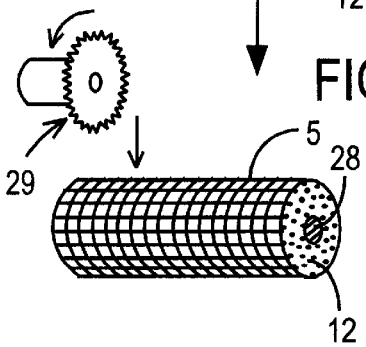

FIG. 5 shows such a skein 12 being manufactured by being wound around an axis 17 of a web sheet 18 comprising fibers of carbon or aluminized glass running parallel to the axis 17.

Illustratively, 150 to 200 m of a web with unidirectional carbon fibers 7 $\mu$ in diameter may be wound to attain a skein of the same density, as in the above embodiment.

FIG. 6 shows the second method stage B, namely impregnating the skein 12 with a material 19 which solidifies at a first temperature.

Ideally, this material is water. Alternatively, it may be a wax or an organic material with a low melting or evaporation point.

The impregnation is carried out by immersing the skein 12 into a tub 20 filled with the impregnation material 19.

In the third stage C, the impregnated skein is placed into a mold 21.

In order to simplify the winding stage, an alternative embodiment teaches several skeins manufactured for subsequent juxtaposition in the same mold.

Figure 3:
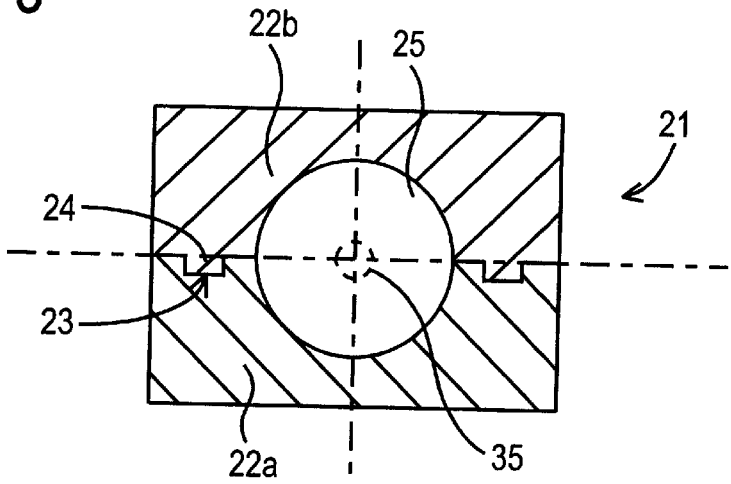
FIG. 3 is a cross-section of a first illustrative mold used in a particular embodiment of the invention.

FIG. 3 shows a first such mold embodiment. This mold comprises two halves 22*a,* 22*b* which by means of mortises 23 and tenons 24 are accurately aligned with each other.

The mold halves 22*a,* 22*b* bind a cylindrical cavity 25 whose diameter corresponds to the diameter of the slices 4. The mold may be made of aluminum.

When the first skein is wound, preferably a mold is selected having a cavity 25 length of exceeding the desired length of the stacked slices. Accordingly, the skein-ends where the fibers were wound on the pins 14 can be withdrawn. As a result, the full length of the cartridge has good homogeneity in loading fibers.

Furthermore, several skeins shorter than the desired stack length may be made. In this manner subsequent cooling and slicing the skein is made easier. The desired number of slices is attained using several skeins, subsequently stacked into the cartridge.

In stage D, shown in FIG. 6, the mold 21 is placed in an enclosure 26 to bring the mold to a first temperature T1 which is less than or equal to the solidification temperature of the impregnation material 19.

When impregnating with water, the mold temperature T1 is set at approximately—30° C.

The enclosure may comprise a conventional freezer or any other cooling system. Alternatively, the mold 21 may be immersed in liquid nitrogen.

In a first implementation of the invention, the solidified skein is withdrawn from the mold and enclosed (stage E1) by a support sheath 5.

Preferably, this support sheath comprises a metal sheet made from a stainless steel screen 20 to 140 $\mu$ thick. The side of the nominal screen mesh may vary between 30 and 210 $\mu$. The sheet is wound around the skein and welded edge to edge by either a laser, or by tinning, to constitute a sheath 5. A heat-welding aluminum foil may also be used.

The sheath 5 keeps the peripheral fibers in place when the slices 4 are cut, as described below. However, this sheath is thin enough not to hamper fiber dispersion when the cartridge becomes operational.

In one embodiment, the sheath 5 is made of a heat-shrinking plastic, for instance Kynar heat-shrink sheath made by Raychem, of which the shrinkage temperature is selected to be less than 150° C.

Machining, or lathing an axial duct 6 is also carried out during this stage E1.

Following machining of the axial duct 6, a tube 28 filled with an impregnation material 19 in the solidified state, is placed inside said duct 6.

This cardboard or plastic tube keeps the fibers in place near the axial duct and during the cutting phase of the slices 4, as described below.

Care is taken during the various steps of handling, soldering, and drilling so that the skein 12 is not heated to the point of losing cohesiveness.

To combat the threat of overheating, one may recurrently immerse the skein in liquid nitrogen.

In stage F, the skein 12, now fitted with its sheath 5, and the tube 28 are cut into slices 4.

The slice thickness is less than 10 mm, preferably in the range of 3 to 6 mm.

Slicing is implemented either by a cutting disk 29, or by laser. One again, the skein's temperature is kept low to prevent loss of cohesion.

Accordingly, the slicing may be carried out under water or the skein may be cooled by periodic immersion in liquid nitrogen.

Once the slices 4 have been cut, they are placed during stage G into a tub 30 at a second temperature T2 selected to eliminate by evaporation or melting the solidifiable material 19.

Using a mesh-like sheath assures porosity to enhance eliminating the material 19 without freeing the fibers.

If water is used as the material 19, a heating enclosure raised to the temperature T2=60° C. will suffice.

Each slice 4 comprises an element of the sheath 5 at its external surface and an element of the tube 28 at its axial duct. The material filling the tube was eliminated together with that had been retained by the fibers. The sheath 5 and the tube 28 provide some mechanical strength to each slice 4, thereby facilitating the subsequent installation of the slices in the cartridge case 2 (stage H).

Next a pyrotechnical dispersal charge may be inserted into the axial duct. The charge per se may be held in a tube, or poured, in bulk, into the axial duct 6.

When the slice diameter is very large, for instance, more than 60 mm, and the thickness reduced, for instance less than 6 mm, the slices may be mounted into the case while still in the solidified state. In such situations, the slice-outfitted case must be placed inside the heating enclosure to assure evacuating the solidifying material. Here, event stage H precedes stage G.

In another embodiment variation, the axial duct may be formed after the slices have been cut and before heating.

Figure 4A:
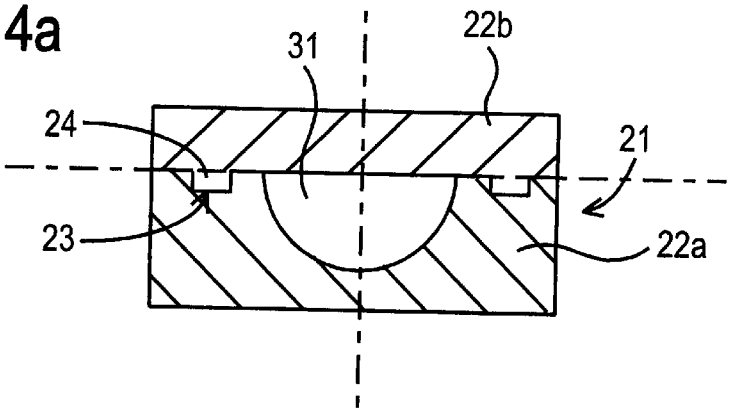
FIG. 4*a* is a cross-section of a second illustrative mold used in a particular embodiment of the invention.

In a second implementing mode of the invention, a mold 21 such as shown in FIG. 4*a* may be used. This mold differs from the one discussed above in that the upper mold half 22*b* is designed as a planar cover. As a result, the mold subtends a semi-cylindrical inner cavity 31.

Such a mold produces a semi-cylindrical skein. This creates two identical solidified skeins which subsequently are joined within a single cylindrical sheath 5. The sheath holds the two halves together.

Such a design advantageously allows higher charge density because it is easier to compress and insert the fibers into the mold.

The axial duct is drilled after the sheath has been mounted.

Figure 4B:
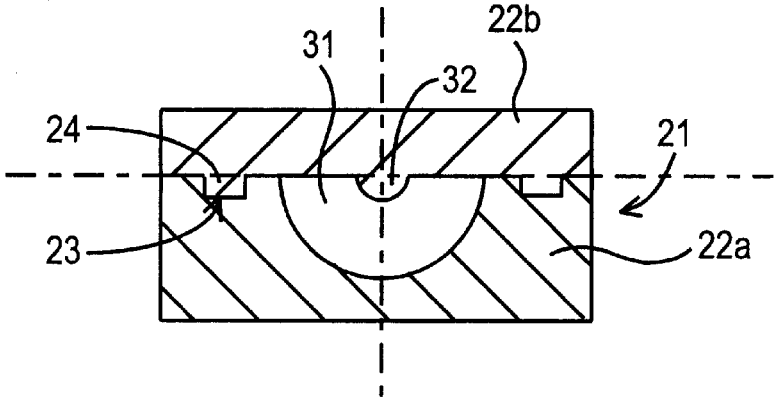
FIG. 4*b* is an embodiment variation of the mold of FIG. 4*a;*

FIG. 4*b* shows a variation of this implementation of the invention wherein the mold cover 22*b* comprises a semi-cylindrical contour 32 allowing a cylindrical, axial half-duct to be inside in the skein.

In this embodiment, again, two semi-cylindrical skeins 12*a,* 12*b* are produced, which are assembled by means of a sheath 5, including the tube 28 enclosing the solidified material.

This method variation is schematically shown in FIG. 6 as stage E3.

Such a design offers the advantage that the axial duct 6 is produced intrinsically without need for drilling.

Figure 7:
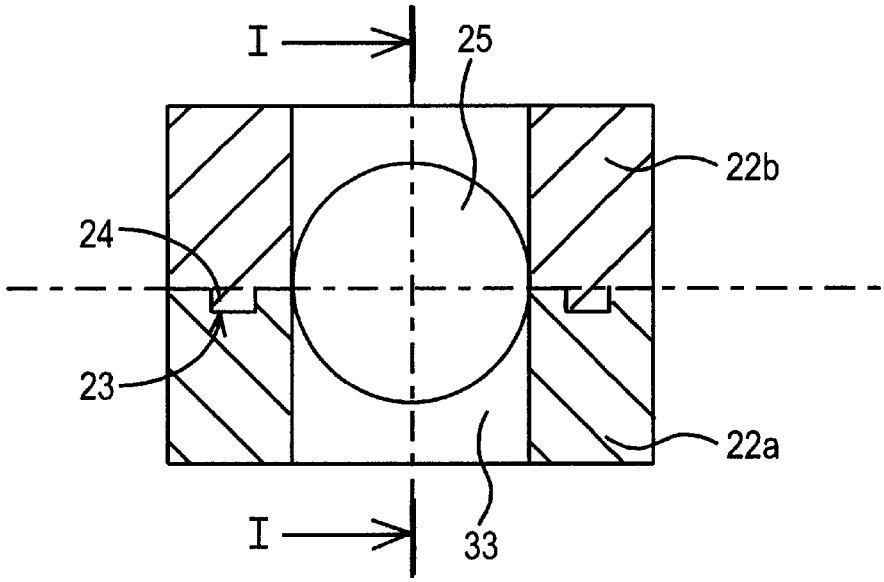
FIGS. 7 and 8 show a third illustrative mold used in a particular implementation of the invention, FIG. 7 being a cross-section of this mold along the plane II—II of FIG. 8, FIG. 8 itself being a longitudinal section of this mold along the plane I—I of FIG. 7.
Figure 8:
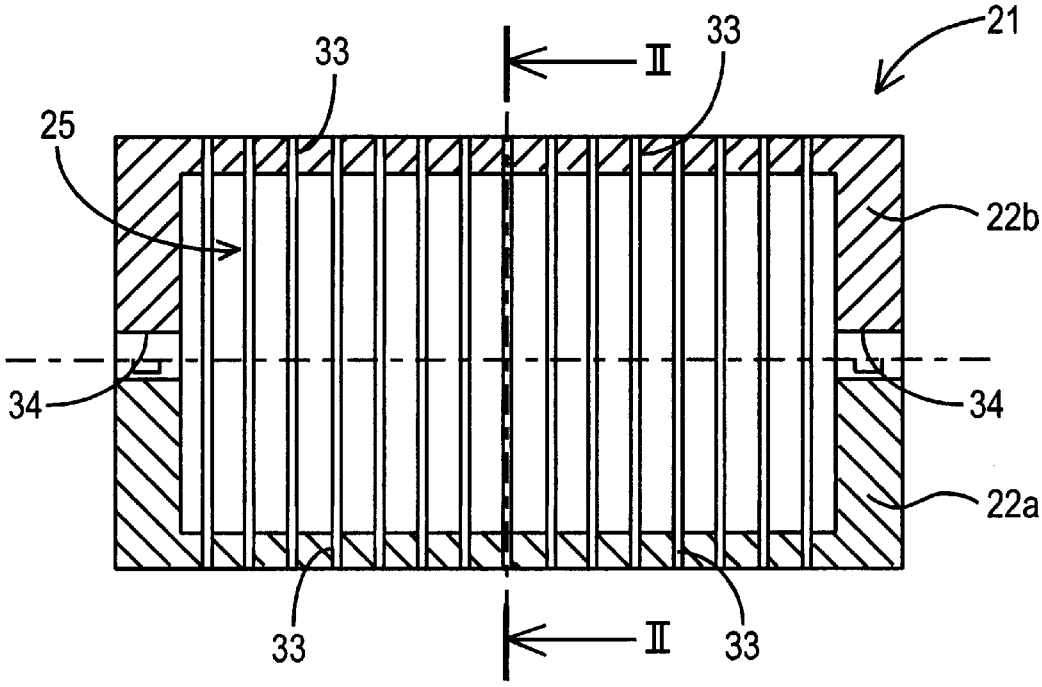

FIGS. 7 and 8 show a mold for use in a third implementation of the invention.

This mold, like the one of FIG. 3, binds a cylindrical, axial cavity 25.

The latter mold differs from the previous one in that each mold half 22*a,* 22*b* has recesses 33 permitting passage of a slicing means, such as a disk, a saw, a water jet, or a laser.

In this mold embodiment, the solidified skein need not be enclosed by a sheath.

When cutting the slices, the mold per se keeps the skein's peripheral fibers in place. The mold's thermal inertia makes it easy to keep the skein in its solidified state.

The mold 21 advantageously is fitted with axial boreholes 34 permitting drilling the skein directly inside the mold. A tube 28 filled with solidified material will be inserted after the axial duct has been drilled—before or after the slices have been cut.

Accordingly, drilling and slicing is carried out directly following the stage D. Thus, slices are produced which can be fitted into the cartridge case.

Preferably, heating directly follows insertion into the case. The stack of cut slices may also be placed into a paper or light-cardboard tube or in a tube of porous material that allows evacuating the solidification material.

The stack is heated in this porous tube and thereupon the assembly installed into the cartridge case.

A number of variations implementing the invention are feasible without limiting its scope.

Illustratively, a skein made in the manner of the technique illustrated by FIG. 2 or just as well a skein made in the manner shown in FIG. 5 can be used in any of the molds described in relation to FIGS. 3, 4*a,* 4*b,* 7 and 8.

Moreover, a mold such as illustrated in FIG. 3 may be fitted with a removable cylindrical core (shown in dashed lines 35 in FIG. 3). This core rests on bearings of the half mold 22*a* and several skeins are placed around said core within the cavity 25. In this manner, following solidification and upon removal of the core, a single solidified skein comprising an axial duct is produced.

Several skeins of lesser length and comprising the desired slice diameter can be made. Following the stages F or G, the number of desired slices—which may be provided by several skeins—are stacked in a case to attain a cartridge (stage H).

The cartridges, made by such a method, allow dispensing carbon or conducting fibers for purposes of screening or to act as decoys within the desired range of wavelengths.

Additionally, cartridges may be designed to disperse such conducting or carbon fibers for the purpose of neutralizing electric systems such as power stations or transformers by creating short circuits.

What is claimed is:

1. A method for stacking short fibers less than 10 mm long into a cartridge, the method comprising:

arranging at least one array of long fibers in at least one skein, impregnating the skein with a material that can solidify at a first temperature, placing the skein so impregnated into a mold, solidifying the skein in the mold by changing the temperature of the mold to a first temperature, cutting the skein in solidified state into at least two solidified slices, each slice being of a that is a desired length of the short fibers, and eliminating the solidifiable material by changing the temperature of the slices to a second temperature.

2. The fiber stacking method of claim 1, wherein the solidified skein is sliced while inside a mold, the mold being fitted with recesses permitting passage of a slicing means.

3. The fiber stacking method of claim 1, wherein the solidified skein is removed from the mold, and then the solidified skein is enclosed by a support sheath before the skein is cut into slices.

4. The fiber stacking method of claim 3, wherein the mold comprises a semi-cylindrical cavity, for imparting a semi-cylindrical shape to a solidified skein, and at least two substantially identical skeins are assembled within a single supporting cylindrical sheath which is then cut into slices.

5. The fiber stacking method of claim 4, wherein the mold comprises a cover having a semi-cylindrical contour for forming a cylindrical, axial half duct in the solidified skein.

6. The fiber stacking method of claim 5 wherein, during forming of the axial duct in the solidified skein and before slicing, a tube filled with impregnation material and in the solidified state is installed inside the axial duct.

7. The fiber stacking method of claim 3, wherein the support sheath is a heat-shrinking sheath.

8. The fiber stacking method of claim 3, wherein the support sheath is a metal sheath.

9. The fiber stacking method of claim 8, wherein the metal sheath is a mesh of width less than 140$\mu$.

10. The fiber stacking method of claim 8, wherein the metal sheath is a foil wound around the skein and soldered edge on edge.

11. The fiber stacking method of claim 1, wherein an axial duct is made by drilling said at least two solidified slices.

12. The fiber stacking method of claim 1, wherein an array of long fibers of the skein is produced by winding a long fiber between two pins firmly affixed to a support.

13. The fiber stacking method of claim 1, wherein long fibers are arrayed into a skein by winding a unidirectional fabric around an axis.

14. The fiber stacking method of claim 1, wherein the solidifiable material comprises water.

15. The fiber stacking method of claim 1, wherein the solidification point of the solidifiable material is higher than 0° C. and the melting or boiling point of the solidifiable material is less than 150° C.

16. The fiber packing method of claim 15, wherein the solidifiable material is a wax.

17. The fiber stacking method of claim 1, wherein the fibers are carbon fibers or glass fibers covered with a conductive material such as aluminum or conductive organic fibers.

18. The fiber stacking method of claim 17 wherein the conductive material is aluminum or conductive organic material.

19. The fiber stacking method of claim 1 wherein the solidifiable material is eliminated before the slices are installed in a case.

* * * * *